US010865064B2

(12) United States Patent
Kawasaki et al.

(10) Patent No.: US 10,865,064 B2
(45) Date of Patent: Dec. 15, 2020

(54) SHEET STACKER, IMAGE FORMING APPARATUS, AND IMAGE SYSTEM

(71) Applicants: Masaaki Kawasaki, Kanagawa (JP); Takahiro Itou, Kanagawa (JP); Hiroshi Hirako, Kanagawa (JP)

(72) Inventors: Masaaki Kawasaki, Kanagawa (JP); Takahiro Itou, Kanagawa (JP); Hiroshi Hirako, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/260,324

(22) Filed: Jan. 29, 2019

(65) Prior Publication Data

US 2019/0233237 A1 Aug. 1, 2019

(30) Foreign Application Priority Data

Jan. 31, 2018 (JP) ..... 2018-015559

(51) Int. Cl.
*B65H 29/24* (2006.01)
*B65H 31/02* (2006.01)
(Continued)

(52) U.S. Cl.
CPC ..... *B65H 29/245* (2013.01); *B65H 1/04* (2013.01); *B65H 29/14* (2013.01); *B65H 31/02* (2013.01);
(Continued)

(58) Field of Classification Search
CPC .... B65H 29/24; B65H 29/245; B65H 29/246; B65H 29/247; B65H 2406/113;
(Continued)

(56) References Cited

U.S. PATENT DOCUMENTS 5,460,361 A * 10/1995 Mokler ..... B65H 29/246 271/183
6,522,841 B2 * 2/2003 Horikoshi ..... B65H 29/14 271/211
(Continued)

FOREIGN PATENT DOCUMENTS

JP 2006-290574 10/2006
JP 2013-184809 9/2013
(Continued)

*Primary Examiner* — Patrick Cicchino
(74) *Attorney, Agent, or Firm* — Harness, Dickey & Pierce, P.L.C.

(57) ABSTRACT

A sheet stacker includes a sheet ejector, a sheet stack portion, and air blowers. The sheet ejector ejects a sheet. The sheet stack portion stacks the sheet ejected by the sheet ejector. The air blowers blow air from blow ports toward the sheet ejected from the sheet ejector. Each of the air blowers includes an air generator, an air guide, a first blow portion, a second blow portion, and a switcher. The air generator generates the air. The air guide guides the air to each of the blow ports. The first blow portion blows the air toward the sheet. The second blow portion blows the air in a direction different from a direction in which the first blow portion blows the air. The switcher performs switching so that the air guide guides the air to one of the first blow portion and the second blow portion.

6 Claims, 11 Drawing Sheets

(51) Int. Cl.

| | |
|---|---|
| ***B65H 1/04*** | (2006.01) |
| ***B65H 29/14*** | (2006.01) |
| *B65H 31/10* | (2006.01) |
| *B65H 33/08* | (2006.01) |
| *B65H 31/38* | (2006.01) |
| *B65H 29/12* | (2006.01) |

(52) U.S. Cl.
CPC ..... *B65H 29/125* (2013.01); *B65H 31/10* (2013.01); *B65H 31/38* (2013.01); *B65H 33/08* (2013.01); *B65H 2301/4212* (2013.01); *B65H 2301/42192* (2013.01); *B65H 2301/4461* (2013.01); *B65H 2405/1122* (2013.01); *B65H 2406/12* (2013.01); *B65H 2406/122* (2013.01); *B65H 2406/14* (2013.01); *B65H 2511/152* (2013.01); *B65H 2801/06* (2013.01)

(58) Field of Classification Search
CPC .. B65H 2406/1132; B65H 2406/11325; B65H 2406/14; B65H 31/16
See application file for complete search history.

(56) References Cited

U.S. PATENT DOCUMENTS

| | | | | |
|---|---|---|---|---|
| 8,727,345 | B2 * | 5/2014 | Konno | B65H 29/246 271/211 |
| 8,936,240 | B2 * | 1/2015 | Hoshino | B65H 29/125 271/211 |
| 9,085,436 | B2 * | 7/2015 | Suzuki | B65H 31/34 |
| 10,144,601 | B2 * | 12/2018 | Masuda | B65H 3/48 |
| 2013/0236228 | A1 | 9/2013 | Nagasako et al. | |
| 2016/0340145 | A1 | 11/2016 | Kunieda et al. | |
| 2016/0355364 | A1 | 12/2016 | Shibata et al. | |
| 2019/0351636 | A1 * | 11/2019 | Akita | B65H 31/10 |
| 2019/0382227 | A1 * | 12/2019 | Sakagami | G03G 21/206 |

FOREIGN PATENT DOCUMENTS

| | | |
|---|---|---|
| JP | 2014-040326 | 3/2014 |
| JP | 2015-007708 | 1/2015 |
| JP | 2015-127840 | 7/2015 |
| JP | 2016-013926 | 1/2016 |

* cited by examiner

SHEET STACKER, IMAGE FORMING APPARATUS, AND IMAGE SYSTEM

CROSS-REFERENCE TO RELATED APPLICATION

This patent application is based on and claims priority pursuant to 35 U.S.C. § 119(a) to Japanese Patent Application No. 2018-015559, filed on Jan. 31, 2018, in the Japan Patent Office, the entire disclosure of which is incorporated by reference herein.

BACKGROUND

Technical Field

Aspects of the present disclosure relate to a sheet stacker, an image forming apparatus, and an image system.

Related Art

In an image forming apparatus such as a copier, a printer, or a digital multifunction peripheral (MFP), there is known a sheet stacker that ejects and stacks a sheet carrying an image while blowing air to the sheet.

SUMMARY

In an aspect of the present disclosure, there is provided a sheet stacker that includes a sheet ejector, a sheet stack portion, and a plurality of air blowers. The sheet ejector ejects a sheet. The sheet stack portion stacks the sheet ejected by the sheet ejector. The plurality of air blowers blows air from a plurality of blow ports toward the sheet ejected from the sheet ejector. Each of the plurality of air blowers includes an air generator, an air guide, a first blow portion, a second blow portion, and a switcher. The air generator generates the air. The air guide guides the air to each of the plurality of blow ports. The first blow portion blows the air toward the sheet. The second blow portion blows the air in a direction different from a direction in which the first blow portion blows the air. The switcher performs switching so that the air guide guides the air to one of the first blow portion and the second blow portion.

In another aspect of the present disclosure, there is provided an image forming apparatus that includes the sheet stacker.

In still another aspect of the present disclosure, there is provided an image system that includes an image forming apparatus and the sheet stacker.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
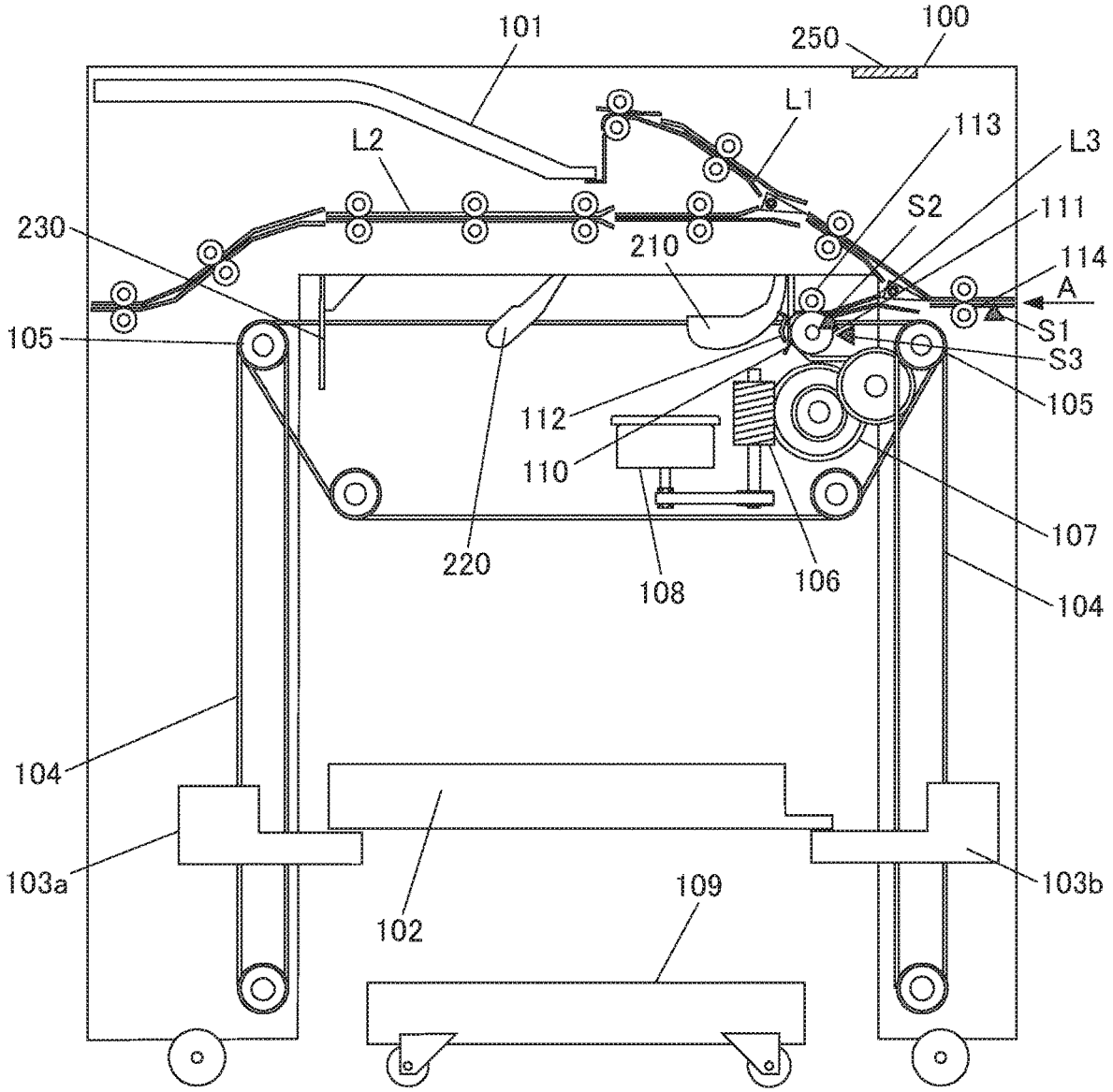
FIG. 1 is a system configuration diagram illustrating a configuration of a stacker being an embodiment of a sheet stacker according to one embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a sheet stacker, an image forming apparatus, and an image system according to embodiments of the present disclosure will be described with reference to the drawings. Since the embodiments described below are preferred embodiments of the present disclosure, and thus include various technically preferable limitations. However, the scope of the present disclosure is not unduly limited by the following description, and not all of the configurations described in the present embodiment are indispensable constituent features of embodiments of the present disclosure.

FIG. 1 is a diagram illustrating a basic configuration of a stacker 100 being an example of a sheet stacker according to an embodiment of the present disclosure. The stacker 100 has a configuration to introduce a sheet S ejected from a copier or the like into the apparatus from a direction of arrow A in FIG. 1. The sheet S is an example of a recording medium handled in the sheet stacker, being a recording medium carrying a formed image and ejected in the image forming apparatus.

The stacker 100 has a plurality of operation modes for ejecting, via a predetermined path, the sheets S introduced into the stacker 100. For example, the stacker 100 can select an operation mode from among a proof eject mode, a straight eject mode, a shift eject mode, and the like.

The proof eject mode is an operation mode in which the sheet S is guided to a proof tray 101 through a sheet conveyance path L1 and stacked. The straight eject mode is an operation mode in which the sheet S is guided to another apparatus provided at a subsequent stage of the stacker 100 through a sheet conveyance path L2. The shift eject mode is an operation mode in which the sheet S is ejected to a shift tray 102 through a sheet conveyance path L3 and the ejected sheet S is stacked. In the shift eject mode, the sheets S can be shifted to different positions on the upper surface of the shift tray 102 and be stacked.

The shift tray 102 is mounted on ascendable/descendable supporting members 103*a* and 103*b* (collectively referred to as supporting members 103 unless distinguished). Four corners of the supporting members 103 are suspended by a total of four timing belts 104, and the individual timing belts 104 are wound around corresponding four timing pulleys 105. One of the timing pulleys 105 is linked by a gear train 107 including a worm gear 106 and a plurality of gears and is synchronously rotated by a driving force of a tray raising/lowering motor 108.

The timing pulley 105 rotates with the rotation of the tray raising/lowering motor 108 to allow the supporting members 103 to ascend/descend together with the shift tray 102. The worm gear 106 is interposed in a power transmission system that transmits the power from the tray raising/lowering motor 108, enabling the shift tray 102 to be maintained at a constant position. When the supporting members 103 descend to a lowermost position, the shift tray 102 can be mounted on a carriage 109 to enable exporting the shift tray 102 together with the sheets S stacked on the shift tray 102, by using the carriage 109.

In the middle of the sheet conveyance path L3, a paddle 110 rotating in conjunction with an ejection roller 111 is disposed. The paddle 110 performs operation of hitting a rear end portion of the sheet S ejected to the shift tray 102 and pressing the sheet S downward.

The sheet S stacked on the shift tray 102 uses its thickness to act to push up a filler 112. Based on the movement of the filler 112, an optical sheet surface sensor S3 is configured to be able to detect the stack height (loading amount) of the sheets S in the shift tray 102. This configuration is used to control to operate the tray raising/lowering motor 108 to lower the shift tray 102 when the sheet surface sensor S3 is ON, and to stop operation of the tray raising/lowering motor 108 (suppressing lowering) when the sheet surface sensor S3 is OFF. Accordingly, the stacker 100 is configured to lower the shift tray 102 by a predetermined distance at a time when the sheet surface sensor S3 is turned on by a certain amount of sheets S being stacked on the shift tray 102.

A sheet conveyance passage sensor S1 to detect passage of the sheet S is provided at an entry port of the sheet to the stacker 100. An entrance roller 114 is provided at the entry port of the sheet S. The entrance roller 114 drives to transport the sheet S ejected in the direction of arrow A from an external apparatus (for example, a copier or the like) into the stacker 100.

In the middle of the sheet conveyance path L3, a sheet conveyance passage sensor S2 to detect the passage of the imported sheet S is disposed. The ejection roller 111 and a driven roller 113 are disposed at the rear stage of the sheet conveyance passage sensor S2 (downstream in the conveyance direction of the sheet S). The driven roller 113 biased by a spring is pressed against the ejection roller 111. The sheet S is nipped between the ejection roller 111 and the driven roller 113.

The sheet S ejected onto the shift tray 102 undergoes alignment in a sheet width direction of the sheet S by a jogger 210 and a sub-jogger 220 constituting a alignment mechanism to align the stacking positions of the sheets S. The sheet conveyance direction of the sheet S undergoes alignment by the leading end stopper 230.

An operation unit 250 is disposed on the outer surface of the upper portion of the stacker 100. The operation unit 250 is a user interface of the stacker 100 and functions as an operation display unit that displays a processing state. The operation unit 250 also functions as an operation instruction unit that gives instructions of user's operation (descending operation, for example) of a tray (the shift tray 102, for example) after image processing.

Next, a shift conveyance mechanism 50 of the stacker 100 will be described with reference to FIG. 2. The shift conveyance mechanism 50 operates to move the ejection roller 111 and the driven roller 113 by a predetermined amount in a predetermined direction to shift the ejection position of the sheet S with respect to the shift tray 102. Here, the moving directions of the ejection roller 111 and the driven roller 113 are two directions, namely, a direction indicated by arrow G1 in FIG. 2 and a direction indicated by arrow G2. The direction of arrow G1 is the front side of the stacker 100 illustrated in FIG. 1, while the direction of arrow G2 is the rear side of the stacker 100. That is, the shift conveyance mechanism 50 is a mechanism that shifts the position of the sheet S ejected to the shift tray 102 to the front side or the rear side. Here, the shift direction of the sheet S by the shift conveyance mechanism 50 is a direction parallel to the surface of the sheet S and orthogonal to the conveyance direction of the sheet S.

The ejection roller 111 and the driven roller 113 are joined to each of a holder 51 and a holder 52 provided as a pair to move in the direction of arrow G1 and the direction of arrow G2, and joined to two shafts, namely a shaft 53 and a shaft 54 joining the holders 51 and 52.

The ejection roller 111 is rotated by a stepping motor 55 regardless of the moving position. A driven gear 56 attached to the ejection roller 111 meshes with a driving gear 60 rotated by the stepping motor 55 via a gear 57, a gear 58, and a belt 59. The driven gear 56 and the driving gear 60 mesh with each other regardless of the moving position (shift direction) of the ejection roller 111. The holder 51 includes a rack gear 61. The rack gear 61 is joined to a pulse motor 63 via a pinion gear 62.

Figure 2:
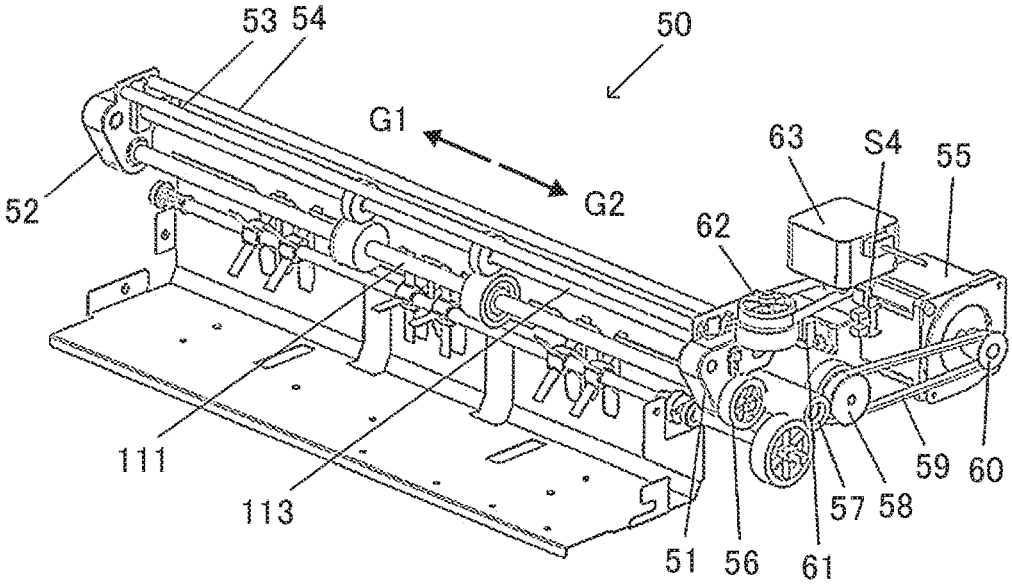
FIG. 2 is a perspective view illustrating a configuration of a shift conveyance mechanism being a portion of an internal structure of the stacker illustrated in FIG. 1.

FIG. 2 is a view of the shift conveyance mechanism 50 viewed diagonally from the upper right of the stacker 100, illustrating a case where the ejection roller 111 is in a center position in a state before the shift movement. In the shift conveyance mechanism 50, the ejection roller 111 and the driven roller 113 are at the center position illustrated in FIG. 2 from the state of FIG. 2 until reception of the sheet S and execution of shift movement. The amount of shift movement of each of the ejection roller 111 and the driven roller 113 is set to a predetermined amount (10 mm) from the center position in each of the direction of arrow G1 and the direction of arrow G2. Home positions of the ejection roller 111 and the driven roller 113 are set to the center position, and there is provided an optical home position sensor S4 to detect that the ejection roller 111 and the driven roller 113 are in the center position. The pulse motor 63 is controlled to perform rotating operation by a predetermined amount with reference to the home position so as to move the ejection roller 111 and the driven roller 113 to a predetermined shift position.

Figure 3:
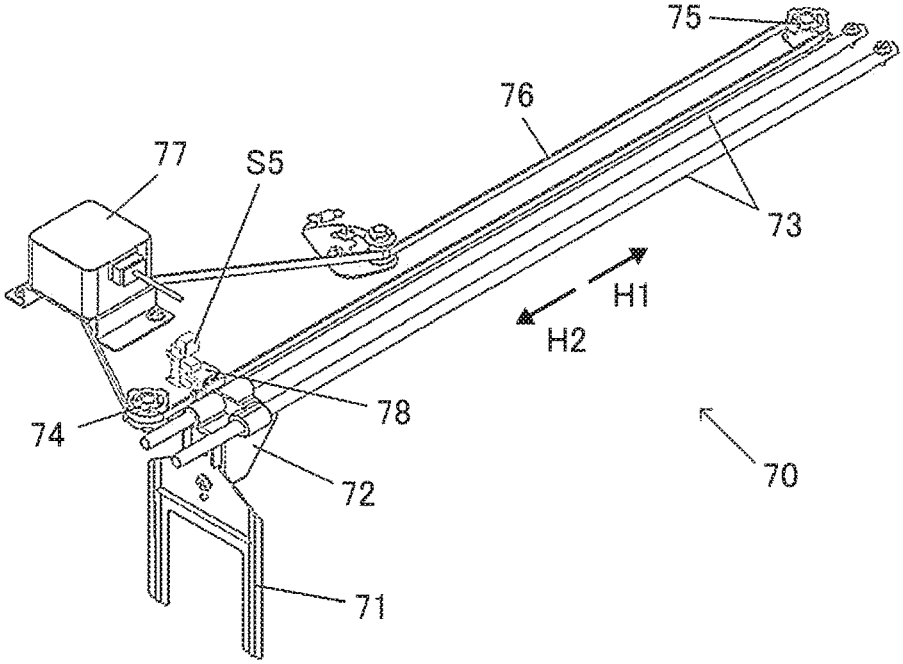
FIG. 3 is a perspective view illustrating a configuration of a leading end aligning mechanism being a portion of the internal structure of the stacker illustrated in FIG. 1.

FIG. 3 is a view illustrating a state in which the leading end aligning mechanism 70 is viewed diagonally from upper left and the front of the stacker 100. The leading end aligning mechanism 70 is a mechanism to align the leading end portion (end portion in the conveyance direction) of the sheet S ejected onto the shift tray 102 and constitutes the leading end stopper 230 of the stacker 100. The leading end aligning mechanism 70 includes a stopper 71 capable of adjusting the position in two directions, namely, a direction indicated by arrow H1 and a direction indicated by arrow H2 in FIG. 3.

The stopper 71 is attached to a slider 72, and the slider 72 is slidably guided by a shaft 73 extending in the direction of arrow H1 as illustrated in FIG. 3. The slider 72 is joined to a belt 76 stretched between a pulley 74 and a pulley 75. With the movement of the belt 76 by a motor 77, the slider 72 moves together with the stopper 71 in the direction of arrow H1, and its position is adjusted.

The slider 72 includes a shielding plate 78. When the stopper 71 moves to the home position, the shielding plate 78 is detected by an optical home position sensor S5.

Figure 4:
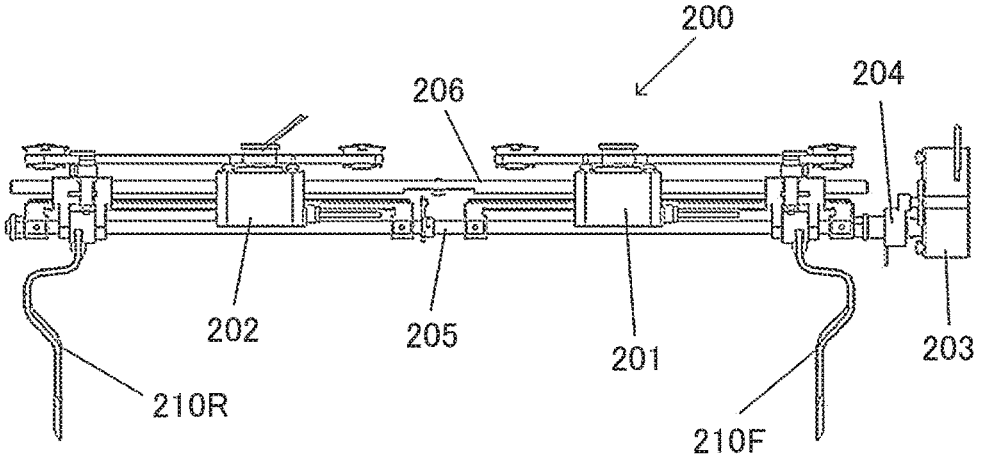
FIG. 4 is a side view illustrating a configuration of a main jogger mechanism being a portion of the internal structure of the stacker illustrated in FIG. 1.
Figure 5:
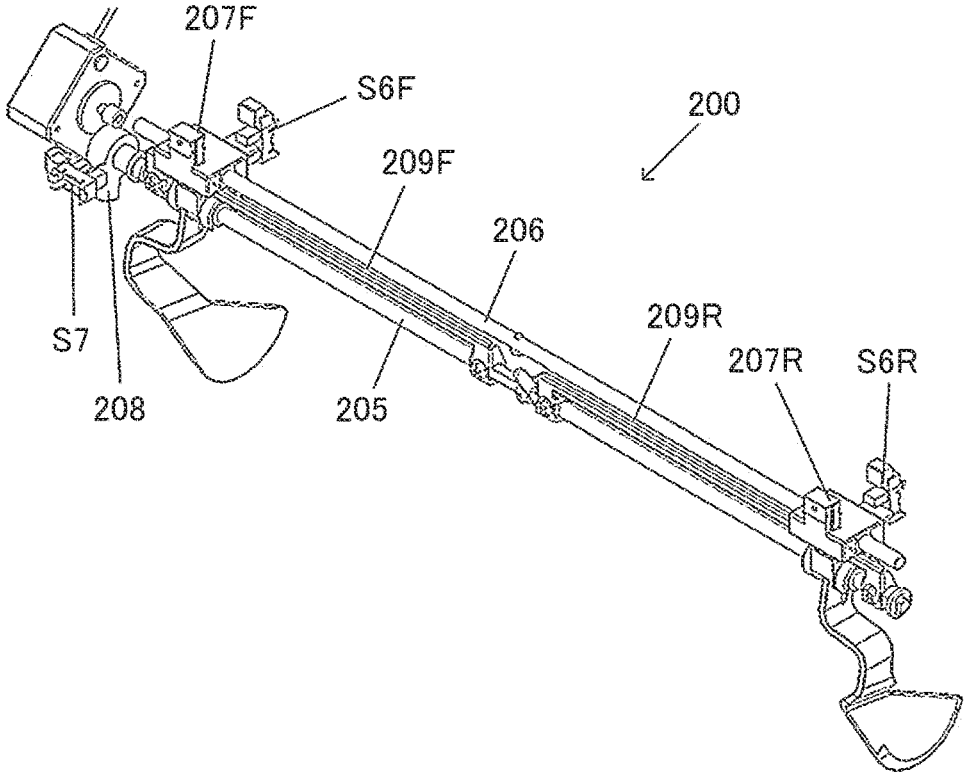
FIG. 5 is a perspective view illustrating a configuration of the main jogger mechanism being a portion of the internal structure of the stacker illustrated in FIG. 1.
Figure 6:
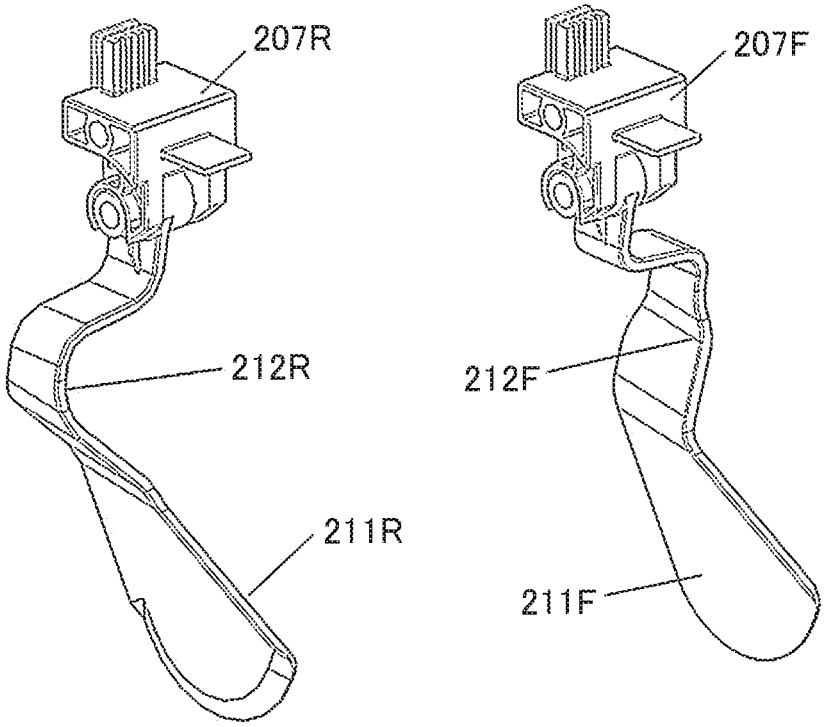
FIG. 6 is a perspective view illustrating a configuration of a jogger being a portion of the main jogger mechanism in FIG. 5.

Next, a main jogger mechanism 200 will be described with reference to FIGS. 4 to 6. FIG. 4 is a view of the main jogger mechanism 200 viewed from the left direction of the jogger 210 in FIG. 1. The right side in FIG. 4 is the front side (frontward) of the stacker 100 and the left side is the rear side (rearward). FIG. 5 is a view of the main jogger mechanism 200 as viewed diagonally from upper right and from rear of the jogger 210 in FIG. 1. The right side in FIG. 5 is the rear side (rearward) of the stacker 100, and the left side is the front side (frontward). FIG. 6 is a view of a portion of the main jogger mechanism 200 as viewed diagonally from upper left and from rear direction in FIG. 1, and illustrating details of a portion of the jogger 210 illustrated in FIG. 1. In FIGS. 4 to 6, a configuration with "R" added at the end of the reference sign indicates that it is disposed on the rear side (rearward) of the stacker 100, and a configuration with "F" indicates that it is disposed in front of (frontward) of the stacker 100.

The main jogger mechanism 200 includes a stepping motor 201 and a stepping motor 202 that control the movement of the jogger 210 in a width direction. The "width direction" represents a direction orthogonal to an ejection direction of the sheet S and parallel to the surface of the sheet S. The main jogger mechanism 200 further includes a stepping motor 203 that controls the movement of the jogger 210 in the vertical direction. The "vertical direction" represents a direction orthogonal to the width direction and orthogonal to the surface of the sheet S.

The main jogger mechanism 200 further includes a gear 204 meshed with the gear of the stepping motor 203, a rotation shaft 205 to which the gear 204 is attached, a drive shaft 206 parallel to the rotation shaft 205, and a slider 207F and a slider 207R joined to the drive shaft 206.

As illustrated in FIG. 5, the main jogger mechanism 200 includes a sensor S6F to detect the slider 207F, a sensor S6R to detect the slider 207R, a filler 208 provided in the gear 204 to indicate a rotation state of the rotation shaft 205, and a sensor S7 to detect the filler 208. Together with the change in the distance between the slider 207F and the slider 207R, the opposing distance between a main jogger 210F and a main jogger 210R changes. The main jogger 210F and the main jogger 210R are also moved in the vertical direction. The state in which the filler 208 is detected by the sensor S7 is the home position in the vertical direction of the main jogger mechanism 200, and the main jogger 210F and the main jogger 210R at this time are in low positions.

Next, the shape or the like of the jogger 210 will be described in detail. As illustrated in FIG. 6, each of the main jogger 210F and the main jogger 210R is formed of a plate-like member. An aligning portion 211F and an aligning portion 211R which are in contact with the end portion of the sheet S at the time of performing alignment of the sheet S in the width direction are located at the lowermost portions of each of the main jogger 210F and the main jogger 210R, and mutually opposing surfaces are each formed from a flat surface orthogonal to a shift direction G.

With the aligning portion 211F and the aligning portion 211R having their opposing surfaces formed as flat surfaces orthogonal to the shift direction G in this manner, it is possible to move the main jogger 210F and the main jogger 210R in the shift direction G to reliably bring the aligning portion 211F and the aligning portion 211R into contact with or separate them from the end surface of the sheet S stacked in the shift tray 102 in the width direction. Such a configuration enables matching and alignment of the width direction of the sheet bundle stacked on the shift tray 102.

When guiding the sheet S ejected from the ejection roller 111 (refer to FIG. 1) to an opposing interval between the main jogger 210F and the main jogger 210R, there is a need to avoid interference between the main jogger 210F and the main jogger 210R, and the ejected sheet S. For this purpose, a stepped relief 212F and a relief 212R which are wider than the opposing interval of the aligning portion 211F and the aligning portion 211R are provided in the upper portion of the aligning portion 211F and the aligning portion 211R.

Returning to FIG. 5. The main jogger 210F and the main jogger 210R are configured to pinch and hold the root by the slider 207F and the slider 207R. The positions of the slider 207F and the slider 207R prevent the main jogger 210F and the main jogger 210R from hanging down beyond a certain state. The slider 207F and the slider 207R hold the main jogger 210F and the main jogger 210R to enable free upward operation.

Each of the main jogger 210F and the main jogger 210R stands by at a receiving position with a predetermined opposing interval at the timing of receiving the sheet S ejected from the ejection roller 111. Every time the sheet S is ejected from the ejection roller 111 and stacked on the shift tray 102, the main jogger 210F and the main jogger 210R perform operation of narrowing the opposing interval from the receiving position, and after moving to the end surface position of the sheet S, they perform operation of expanding the opposing interval and then return to the receiving positions. This series of aligning operation enables alignment of the end surfaces of the sheet S in the width direction.

The ejection roller 111 repeats shift operation (10 mm shift) in the direction of arrow G1 for each of the sheets S and finishes ejecting a predetermined number of sheets constituting the preceding sheet bundle, and then performs 10 mm shift operation in the direction of arrow G2 to stack the succeeding sheet bundle. At the time of switching the shift direction, the main jogger 210F and the main jogger 210R move to a retraction rotational position. This movement establishes an aligning member retraction state, and the main jogger 210F and the main jogger 210R perform the shift operation in this retraction state.

For example, in a case where the ejection roller 111 shifts to the main jogger 210F side, the main jogger 210R is disposed at a position where it abuts on the rear side and on the front "part" (sheet bundle) of the ejected sheet stacked on the shift tray 102. The other main jogger 210F is located on a front side of the sheet stacked on the shift tray 102, and takes the home position as the vertical position.

Every time the shift operation of the ejection roller 111 is reversed, the rotation shaft 205 is rotated in a direction that an arm 209F and an arm 209R attached to the rotation shaft 205 press the roots of the main jogger 210F and the main jogger 210R downward so as to move the rotation shaft 205 to a retraction position.

Every time the shift operation occurs, the aligning member on the opposite side is abutted against (mounted on) the sheet bundle of the previous "part", so as to align the ejected sheet bundle. At this time, the friction coefficient is set to the value that suppresses deviation of the sheet S by the main jogger 210F and the main jogger 210R, enabling stable alignment of the sheets S.

The retraction amount of the main jogger 210F and the main jogger 210R is the retraction amount from the home position where the filler 208 is detected by the sensor S6.

This allows the ascending amount to be constant at all times. In a case where the home position is not moved (raised) to the position of the ejected bundle uppermost surface+$\alpha$, the aligned bundle would collapse due to interference (contact) with the stacked sheet bundle which is moved in shift operation. Here, "+$\alpha$" is a certain point up to the uppermost position, and a large $\alpha$ value would increase the margin for bulging due to curling and folding of the ejected sheet S. On the other hand, when the paper gap is clogged, it would take time to recover at reception of the next sheet.

Figure 7:
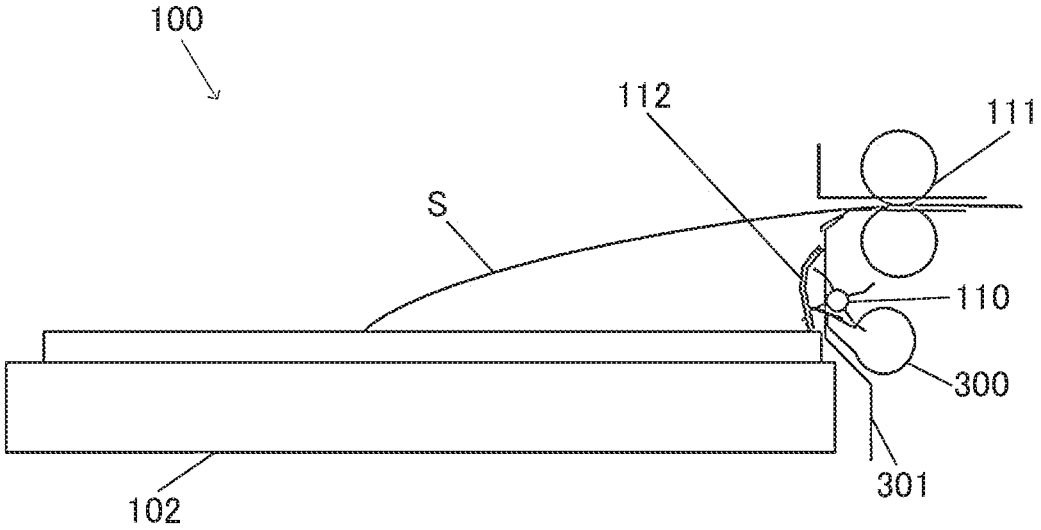
FIG. 7 is a view illustrating a fan being an air blower provided in the stacker according to the present embodiment.
Figure 8:
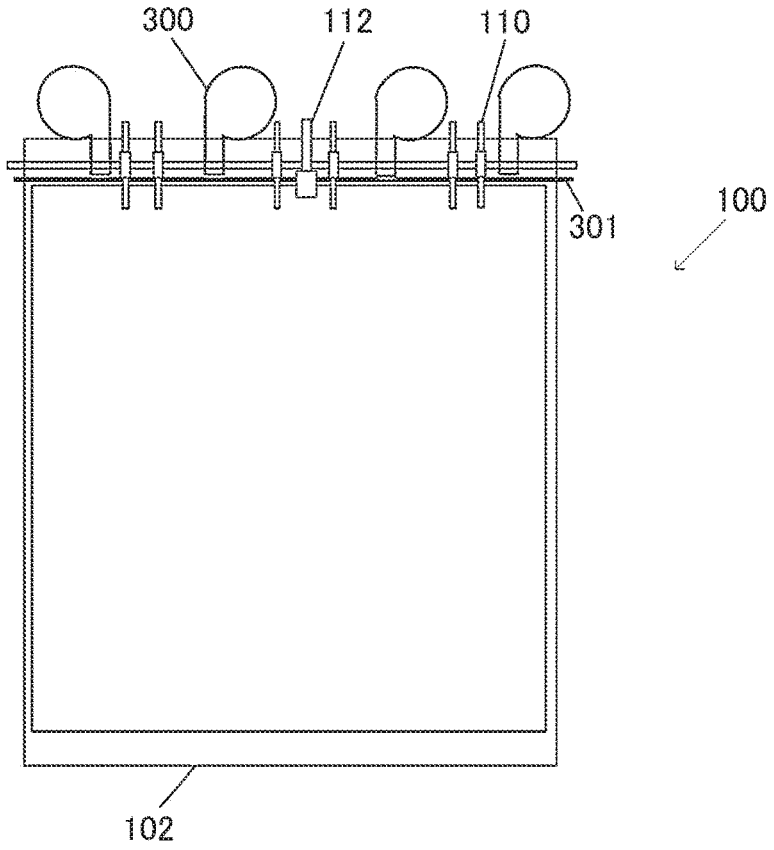
FIG. 8 is a view illustrating an example of arrangement of fans according to the present embodiment.

Next, an air blower provided in a sheet stacker according to one embodiment of the present disclosure will be described. A fan 300 illustrated in FIGS. 7 and 8 is an embodiment of an air blower provided in the stacker 100. As illustrated in FIG. 7, the fan 300 is arranged further below the paddle 110 arranged below the ejection roller 111, and includes an air blower structure to blow the ejected sheet S from the downward direction. The sheet S ejected to the shift tray 102 by the operation of the ejection roller 111 is going to be stacked on the shift tray 102 while receiving the air from the fan 300 from below.

As illustrated in FIG. 8, the plurality of fans 300 is arranged in the width direction of the sheet S. The filler 112 is disposed near substantially the center in the width direction of the sheet S. The same number of fans 300 are arranged on one side (front side) and the other side (rear side) in the width direction with respect to the filler 112 as the center. The plurality of fans 300 is arranged on the outer side of the shift tray 102 as compared with an end fence 301 which is the alignment surface in the conveyance direction of the sheet S. The arrangement interval of the fans 300 may be any arrangement as long as the ports to blow air toward the sheet S are equally spaced. The arrangement interval of the fans 300 is not limited to this.

Figure 9:
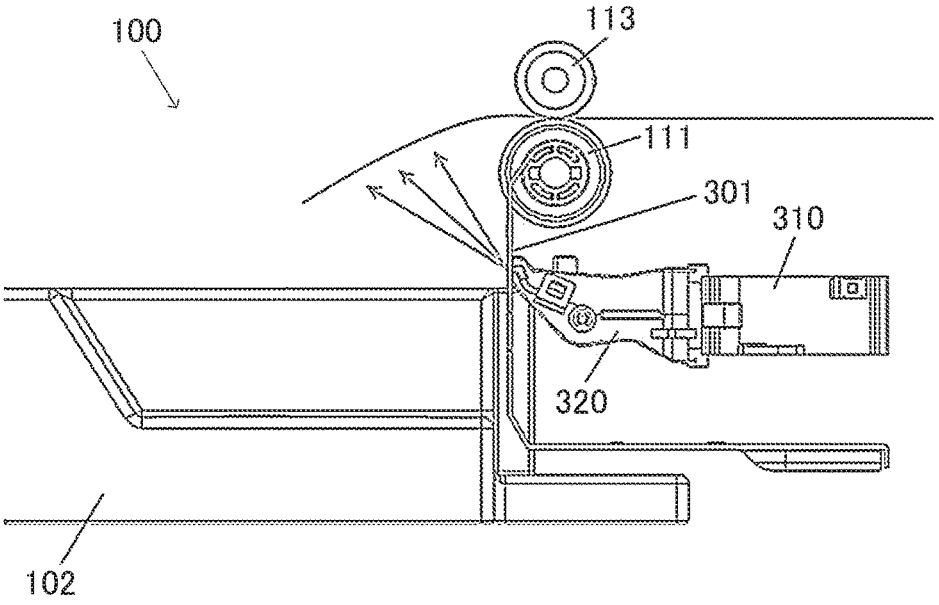
FIG. 9 is a view illustrating operation of the fan according to the present embodiment.

Next, the configuration of the stacker 100 including the fan 300 will be further described. As illustrated in FIG. 9, the stacker 100 includes: the shift tray 102 as a sheet stack portion to stack the sheets S ejected by the ejection roller 111 and the driven roller 113 being a sheet ejector; and an end fence 301 serving as an alignment surface of the ejected sheet S in the conveyance direction. The fan 300 includes: a fan motor 310 as an air generator to generate air to be blown toward the sheet S; and a duct 320 to guide the air generated by the fan motor 310 so as to blow out in a predetermined direction. The duct 320 is a blower pipe constituting a blow port to send the air toward the sheet S from the lower side of the ejection roller 111 inside the end fence 301 (on the shift tray 102 side).

Figure 10:
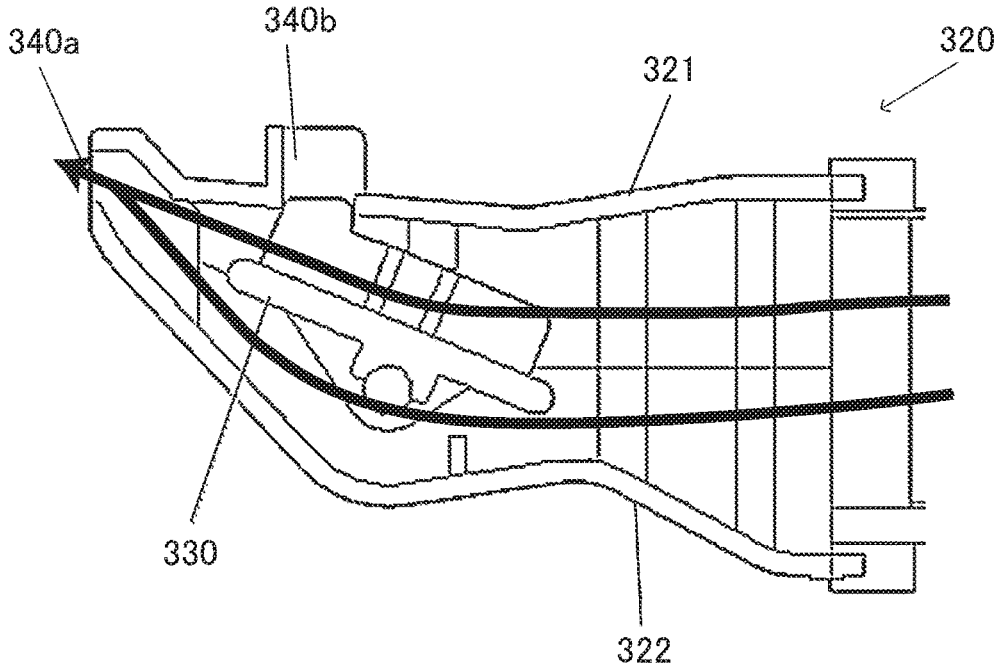
FIG. 10 is a view illustrating a structure of a duct constituting a fan according to the present embodiment.
Figure 11:
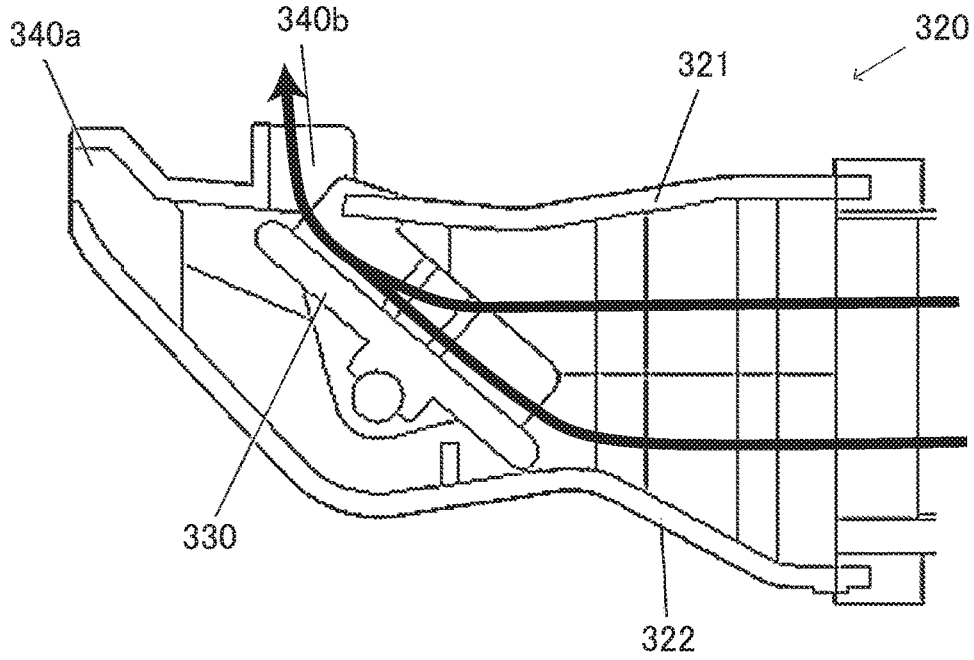
FIG. 11 is a view illustrating a structure of the duct constituting the fan according to the present embodiment.

Next, the structure of the duct 320 will be described with reference to FIGS. 10 and 11. As illustrated in FIGS. 10 and 11, the duct 320 is a conduit member formed with an upper blower duct member 321 and a lower blower duct member 322, and is an air guide to guide the air flow direction. Hereinafter, the flow of air (the direction of the air) will be drawn with thick arrows. The duct 320 includes: a blow port 340*a* being a "first blow port" that blows air to the ejected sheet S and constituting a first blow portion; and a blow port 340*b* being a "second blow portion" that blows air in a direction different from the first blow portion and constituting a second blow portion. A switcher 330 to select and switch the blow ports is disposed in an internal space of the duct 320 including the upper blower duct member 321 and the lower blower duct member 322 at a position in proximity to the blow port 340*a* and the blow port 340*b*. While FIGS. 10 and 11 illustrate two blow ports in the duct 320, embodiments of the present disclosure are not limited to such a configuration, and a blow port may be additionally provided as necessary.

FIG. 10 is a view illustrating a state of the switcher 330 at the time of ejection of the sheet S. When the sheet conveyance passage sensor S1 detects passage of the sheet S, a state is generated in which air from the fan motor 310 is guided toward the blow port 340*a* so as to blow air against the sheet S ejected through the ejection roller 111. FIG. 10 illustrates an exemplary state of this. When the switcher 330 is in this state, air is blown in the ejection direction of the sheet S to hit the sheet S. As illustrated in FIG. 10, at the time of ejecting the sheet S, the switcher 330 falls back and stopped in a gently inclined state toward the traveling direction of the air.

FIG. 11 is a view illustrating a state of the switcher 330 before and after ejection of the sheet S. When the sheet conveyance passage sensor S1 has transitioned from a sheet S detection state to a sheet S non-detection state (when the sheet S has been ejected), the switcher 330 enters the state illustrated in FIG. 11 in order to guide the air to the blow port 340*b*, instead of blowing air to the sheet S. This allows the air to be blown out in a direction different from the sheet S to be ejected. This makes it possible to achieve an effect of suppressing disturbance of the position of the stacked sheets S by air blowing when there is a possibility that air blowing might adversely affect the sheet alignment operation or the like. As illustrated in FIG. 11, when ejection of the sheet S is not performed (when the sheet S is separated from the ejection roller 111 and stacked on the shift tray 102), the switcher 330 is erected to be steep toward the air traveling direction to be stopped in a state where the air is guided to the blow port 340*b*.

The switcher 330 operates to rotate on a predetermined axis, for example, as a driving source of the electric motor so as to switch the state illustrated in FIGS. 10 and 11. The electric motor can be used as the driving source for the rotational operation so as to switch the angle instantaneously. This makes it possible to instantaneously select and switch an air flow direction from the fan 300 in accordance with the ejection situation of the sheet S.

Figure 12:
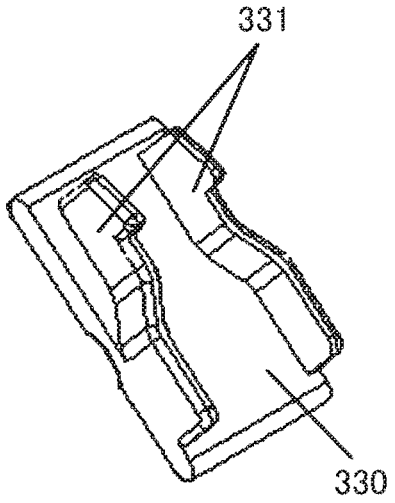
FIG. 12 is a view illustrating an example of switcher used for the duct according to the present embodiment.

Next, the structure of the switcher 330 will be described in more detail. FIG. 12 is a perspective view illustrating the switcher 330. The switcher 330 includes an air flow regulating member 331 to regulate the air flow in order to guide the air flow generated by the fan motor 310 in a predetermined direction. The air flow regulating member 331 enables the switcher 330 to guide the air flow in a predetermined direction and to control the air flow direction.

Figure 13:
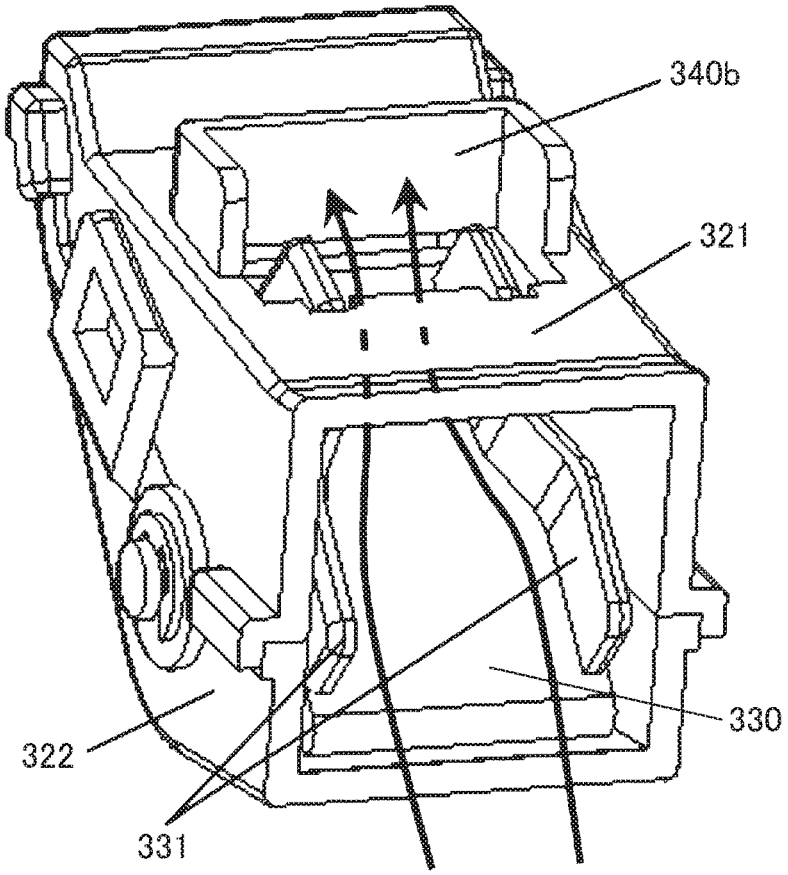
FIG. 13 is a perspective view illustrating an example of air flow in the duct according to the present embodiment.

FIG. 13 is a view illustrating a state in which the air flow regulating member 331 guides the air in the state of the switcher 330 when it blows air to the blow port 340*b* in a direction different from the ejected sheet S. As illustrated in FIG. 13, the air flowing in an internal space of the duct 320 is blocked from flowing in the side direction by the air flow regulating member 331 and guided in a predetermined direction from the downstream to the upstream in the air flow direction. Here, the predetermined direction is either a direction toward the blow port 340*a* or a direction toward the blow port 340*b*. As illustrated in FIG. 13, the air flow path in the switcher 330 is such that the interval (opposing interval) of the opposing width is reduced from the downstream in the air flow direction to the upstream in the air flow direction by the air flow regulating member 331. In other words, the switcher 330 includes the air flow regulating member 331 that tapers the flow path from the downstream in the air flow direction of the air to the upstream in the air flow direction. This structure gradually increases the speed of the flow toward the blow port 340*a* or the blow port 340*b* so as to be able to blow the air vigorously. This makes it possible to increase an effect on the behavior of the sheet S using the blown out air as will be described below.

Figure 14:
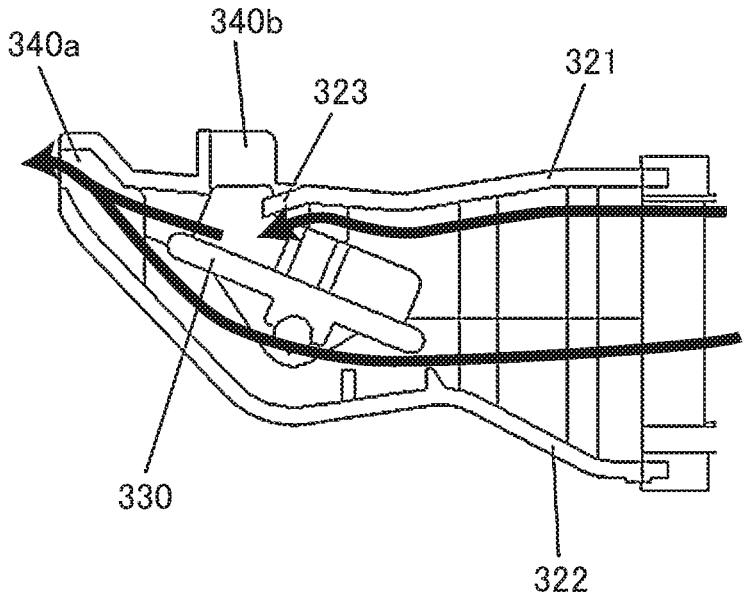
FIG. 14 is a perspective view illustrating an example of air flow in the duct according to the present embodiment.
Figure 15:
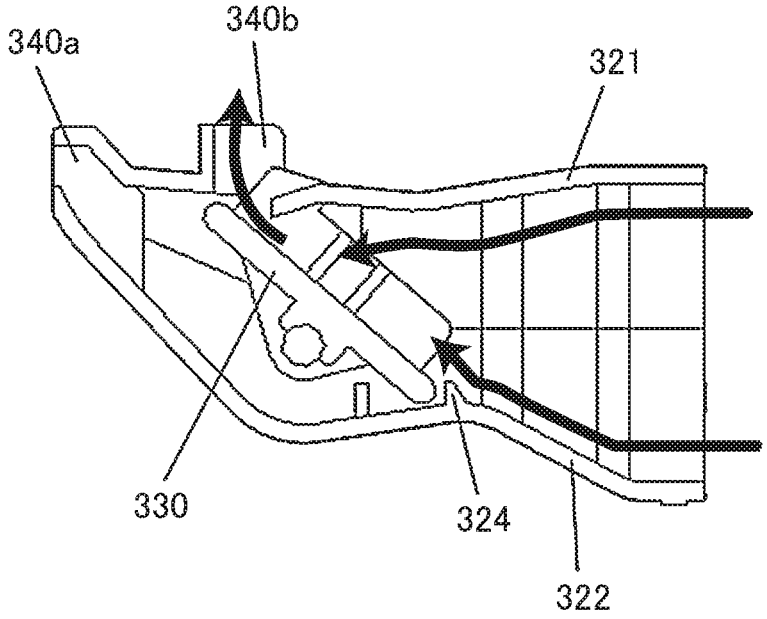
FIG. 15 is a perspective view illustrating an example of air flow in the duct according to the present embodiment.
Figure 16:
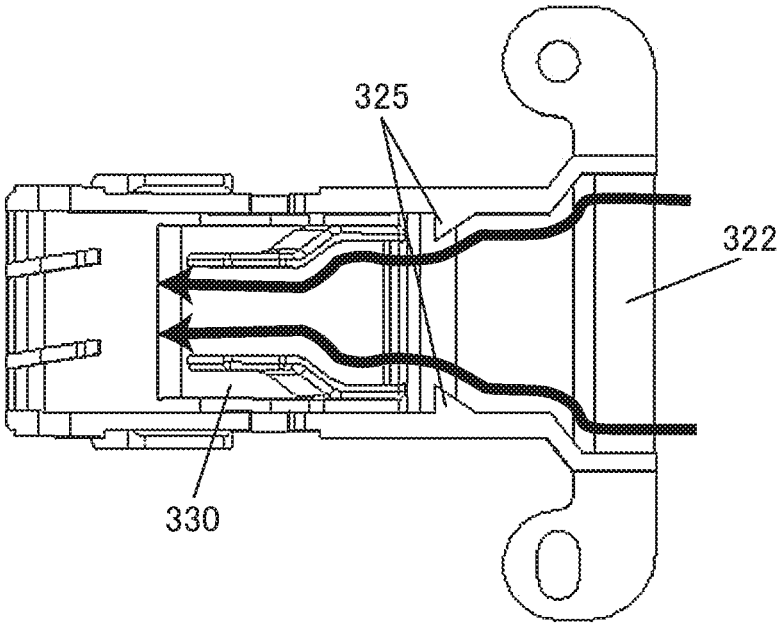
FIG. 16 is a perspective view illustrating an example of air flow in the duct according to the present embodiment.

The duct 320 as well has a structure that achieves flow regulating effects. FIG. 14 is a view illustrating arrangement and operation of an upper flow regulator 323 that exhibits the flow regulating effects on the duct 320. FIG. 15 is a view illustrating arrangement and operation of a lower first flow regulator 324 that exhibits flow regulating effects on the duct 320. FIG. 16 is a view illustrating arrangement and operation of a lower second flow regulator 325 that exhibits flow regulating effects on the duct 320.

FIG. 14 illustrates a state where the switcher 330 is switched so as to guide the air to the blow port 340*a* that blows air toward the sheet S at the time of ejecting the sheet S. As illustrated in FIG. 14, the upper flow regulator 323 is provided at a portion where a portion of the blow port 340*b* is inclined toward the inner direction of the duct 320. The air flowing on the upper side of the internal space of the duct 320 hits the upper flow regulator 323 and is led to the upper surface side of the switcher 330. The air flowing on the upper surface side of the switcher 330 is guided in a direction of the blow port 340*a* by the air flow regulating member 331 (refer to FIG. 12). Furthermore, when the switcher 330 is brought into a state of being tilted toward the direction in which the air flows, the air flowing downward in the internal space of the duct 320 flows to the lower surface side of the switcher 330 and is guided toward the blow port 340*a*. As a result, it is possible to prevent the air from leaking from the blow port 340*b* when the sheet S is ejected.

FIG. 15 illustrates a state in which the switcher 330 is switched so as to guide the air to the blow port 340*b* that blows air in a direction different from the direction of the ejected sheet S. As illustrated in FIG. 15, the lower first flow regulator 324 of the lower blower duct member 322 is a protrusion formed by a portion of the inner wall of the lower blower duct member 322 protruding toward the internal space side of the duct 320, and is provided near the center of the lower blower duct member 322 in the longitudinal direction. When the switcher 330 is erected toward the air flow, the lower end of the switcher 330 is located closer to the inner wall side of the duct 320 than the lower first flow regulator 324. When the switcher 330 is viewed from the direction of air flow, the lower end portion is in a position hidden by the lower first flow regulator 324. This allows the air flowing on the lower side of the internal space of the duct 320 (on the side of the lower blower duct member 322) to hit the lower first flow regulator 324 so as to be guided to the upper surface side of the switcher 330. The air flowing on the upper surface side of the switcher 330 is guided by the air flow regulating member 331 (refer to FIG. 12) in a direction of the blow port 340*b*. This makes it possible, after the sheet S is ejected, to prevent the air from leaking from the blow port 340*a*, inhibiting the air from being blown to the side where the sheet S is stacked.

FIG. 16 is a view illustrating the lower second flow regulator 325, being a cross-sectional view when the duct 320 is cut in the lateral direction. As illustrated in FIG. 16, the lower second flow regulator 325 is a protrusion of the inner wall of the lower blower duct member 322 protruding toward the internal space side, and has an inclination surface inclined inward along the air flow direction. The lower second flow regulator 325 is provided slightly on more toward the side of the fan motor 310 (refer to FIG. 9) than in the vicinity of the center in the longitudinal direction of the lower blower duct member 322. The air guided to the switcher 330 is guided by the lower second flow regulator 325 along the inner wall of the duct 320 to the inner side where the upper surface side of the switcher 330 is disposed. At this time, the dimension in the width direction of the flow path gradually narrows in combination with the action of the air flow regulating member 331. Even when there is a gap between the inner wall of the duct 320 and the side surface portion of the switcher 330, the action of the lower second flow regulator 325 works to guide the air in a direction to prevent the air from flowing into this gap.

According to the duct 320 having the above structure, it is possible to use the air flow regulating member 331, the upper flow regulator 323, the lower first flow regulator 324, and the lower second flow regulator 325 of the switcher 330 so as to guide the air flow generated by the fan motor 310 toward the blow port 340*a* or the blow port 340*b*. Moreover when leading the air, it is possible to prevent the air from leaking from the side surface of the switcher 330 or the like in an unintended direction and to prevent the air from blowing out from the blow port 340*a* or the blow port 340*b* at an unintended timing.

Next, operation of the stacker 100, switching operation of the switcher 330 in particular, will be described with reference to FIGS. 17 and 18.

Figure 17:
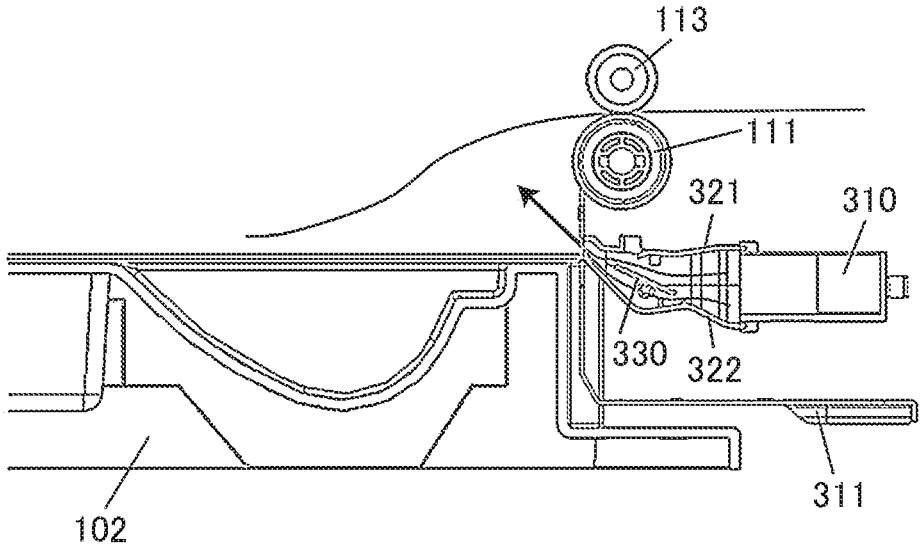
FIG. 17 is a view illustrating a state in which the fan according to the present embodiment blows air to a sheet.

FIG. 17 is a view illustrating a state where air is blown toward the sheet S being ejected. As illustrated in FIG. 17, when the sheet S passes between the ejection roller 111 and the driven roller 113 to be ejected, the sheet conveyance passage sensor S1 and the sheet conveyance passage sensor S2 detect the sheet S. The fan motor 310 starts its operation at the time when the sheet conveyance passage sensor S1 has detected the sheet S, and operates until the sheet conveyance passage sensor S1 no longer detects the sheet S. Alternatively, the fan motor 310 starts its operation at the time when the sheet conveyance passage sensor S1 has detected the sheet S, and operates until the sheet conveyance passage sensor S1 and the sheet conveyance passage sensor S2 no longer detect the sheet S. Therefore, when the sheet S is being ejected, the air flow generated by the fan motor 310 is guided in a direction of the blow port 340*a* by the switcher 330 of the duct 320 and hits the ejected sheet S. With this air blowing state, the sheet S is smoothly ejected onto the shift tray 102 and stacked.

Figure 18:
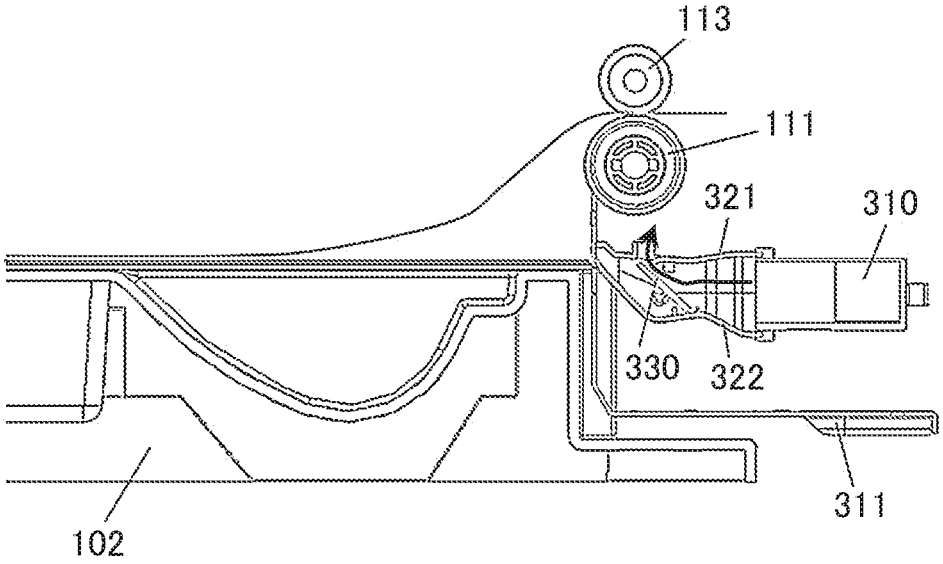
FIG. 18 is a view illustrating a state in which the fan according to the present embodiment blows air to a sheet.

FIG. 18 is a view illustrating a state in which the air blowing direction is switched into a direction different from the ejection direction of the sheet S. As illustrated in FIG. 18, when the sheet conveyance passage sensor S1 is turns to a state of not detecting the sheet S, the switcher 330 is operated so as to guide the air blown from the fan motor 310 in a direction of the blow port 340*b*. At this time, the air flow generated by the fan motor 310 is in a state in which it does not affect the ejection of the sheet S.

Next, the relationship between the operation at the time of ejecting the sheet S in the stacker 100 and the operation of the fan 300 as an air blower will be described.

First, when the sheet conveyance passage sensor S1 detects the sheet S at a first stage, the fan motor 310 is operated to generate an air flow. At this time, the switcher 330 is inclined in the direction of the air. When the switcher 330 is inclined, the state goes into a state where the air blows out from the blow port 340*a* toward the ejected sheet S before the leading end of the sheet S ejected from the ejection roller 111 reaches the shift tray 102 (air blowing to the sheet S is turned on).

Subsequently, when the sheet conveyance passage sensor S1 stops detecting the sheet S at a second stage, the time when the trailing end of the sheet S passes through the position of the sheet conveyance passage sensor S1 indicates it is close to the completion of the ejection of the sheet S. Therefore, the switcher 330 is operated so as to blow out air in a direction different from the direction of the sheet S before the trailing end of the sheet S reaches the shift tray 102. This allows a state where the air blows out from the blow port 340*b*, while suppressing the air being blown out from the blow port 340*a* (blowing air to the sheet S is turned off).

As described above, the operation of the fan motor 310 and the operation of the switcher 330 can be controlled in accordance with the detection state of the sheet S, making it possible to control the air blowing state based on the ejection state of the sheet S. With this control, even when a sheet S susceptible to the influence of the air flow and easily causing deterioration in stackability such as a thin sheet is ejected, it is possible to blow out the air in a direction to urge the ejection of the sheet S at the time of ejection to be stacked on the shift tray 102, thereby improving the productivity. In addition, in order to suppress deterioration in stackability due to disturbance of the stacked sheets S, the air is controlled to be blown in the direction not to hit the sheet S at the timing when the trailing end of the sheet S reaches the shift tray (timing at which air affects the stacking). Since stopping the fan motor 310 at the timing when the trailing end of the sheet S reaches the shift tray would not be able to instantly stop the air blowing, and thus, switching operation of the switcher 330 is used to instantaneously switch the air blowing direction. This makes it possible to prevent the air flow used for increasing the productivity at the time of ejecting the sheet S from disturbing the stackability.

Note that the operation state of the fan motor 310 may be controlled in conjunction with the switching operation of the switcher 330 described above. For example, after turning on the air flow to the sheet S, the control may be performed such that the driving voltage of the fan motor 310 be first raised to increase the air generation amount, and thereafter, the driving voltage be gradually lowered as the ejection situation of the sheet S advances, and the drive voltage of the fan motor 310 be further lowered so as to decrease the air flow rate when the air flow to the sheet S is turned off. With this control, it is possible to control the driving amount of the fan motor 310 in conjunction with the switching operation of the air blowing direction, enabling further reduction of the influence of the air flow at unnecessary times. Together with this, it is possible to reduce the power consumption.

Further, the air blowing rate may be controlled by intermittently controlling ON/OFF of the fan motor 310 without raising and lowering the driving voltage. Furthermore, the drive voltage of the fan motor 310 can be controlled to be zero when the air flow to the sheet S is turned off, making it possible to set a large difference in air blowing rate in conjunction with the switching operation by the switcher 330.

The timing of switching ON/OFF of the fan motor 310 may be controlled in conjunction with the size of the sheet S to be ejected.

For example, when the sheet S to be ejected has a large size, a sufficient air blow can be obtained while the sheet S passes. Therefore, when the sheet size is large, the fan motor 310 may be turned off earlier than when the sheet size is small to stop the air blowing. Similarly, the timing at which the fan motor 310 is turned on to start air blowing may be set to an air blowing timing suitable for the size of the sheet S.

Meanwhile, the fan motor 310 has some time lag until it reaches a state of achieving the maximum air flow rate when operating from a stop state. Therefore, the timing of switching the switcher 330 in the direction of turning on the air can be adjusted so that the fan motor 310 can be operated before the operation of the switcher 330 so as to be able to obtain the maximum air flow rate, making it possible to obtain a sufficient blowing effect from the beginning of ejection of the sheet S (from the first sheet).

Figure 19:
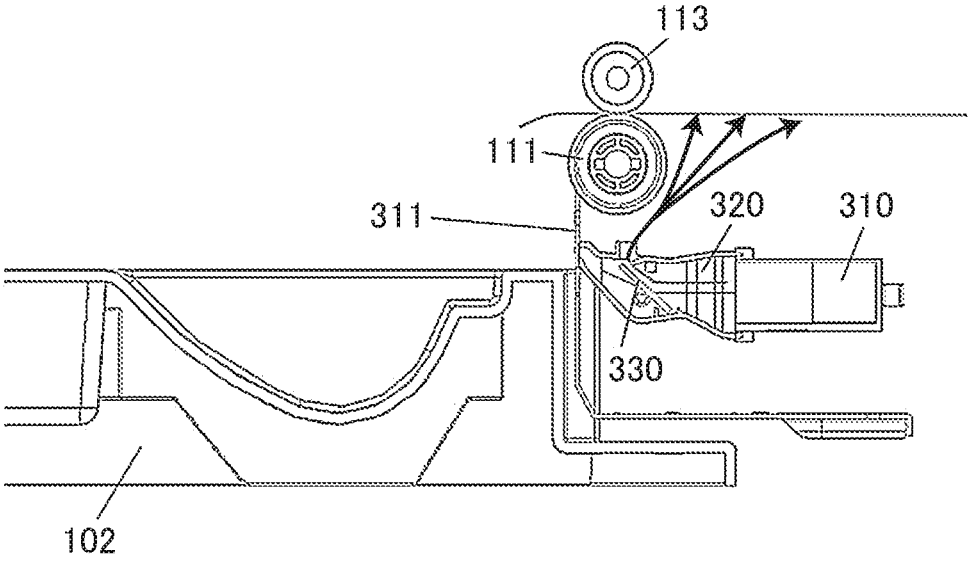
FIG. 19 is a view illustrating a state in which the fan according to the present embodiment does not blow air to the sheet.

Next, an example of use of air when switcher 330 is switched so as to blow air from the blow port 340*b* will be described. As illustrated in FIG. 19, the air ejected in a direction different from the ejected sheet S blows upward in the duct 320.

Therefore, the fan motor 310 can be operated at the same time that the sheet conveyance passage sensor S1 detects the sheet S so as to allow the air to be blown out from the blow port 340*b*, and allow the air to pass above the blow port 340*b* to be blown toward the sheet S under conveyance before passing through the ejection roller 111.

In this manner, air can be blown to the sheet S ejected from the ejection roller 111 toward the shift tray 102 before the sheet passage of the ejection roller 111, making it possible to achieve an effect of drying the ink or toner printed by the copier or the like. In addition, it is possible to obtain the effect of lowering the temperature of the conveyed sheet S.

Figure 20:
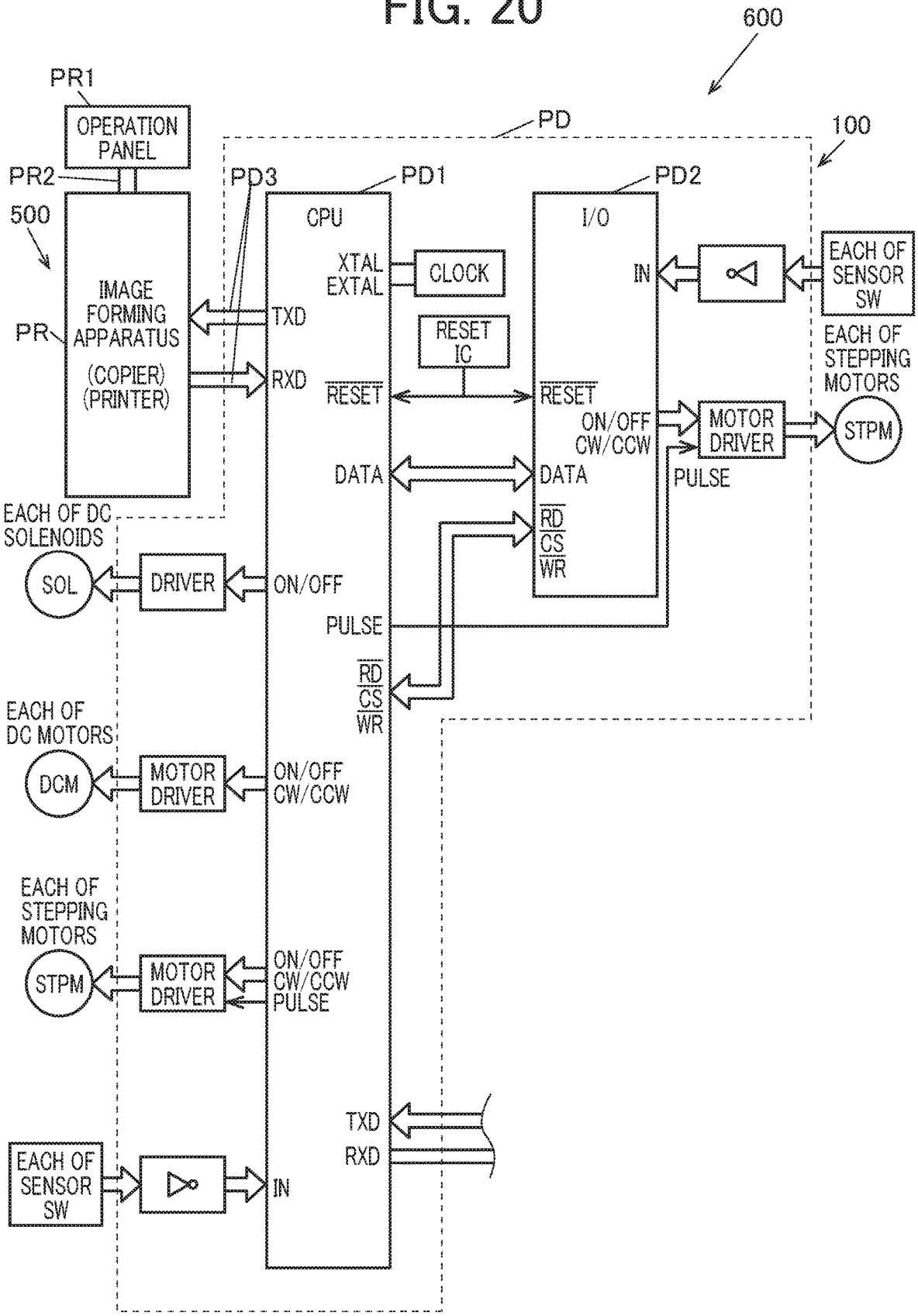
FIG. 20 is a diagram illustrating an example of a functional configuration of a sheet stacker, an image forming apparatus, and an image system according to an embodiment of the present disclosure.

Next, FIG. 20 is a block diagram illustrating an example of a functional configuration of the stacker 100 and a printer 500 which is an embodiment of an image forming apparatus. As illustrated in FIG. 20, the stacker 100 and the printer 500 cooperate with each other to constitute a printer system 600 which is an embodiment of an image system. The stacker 100 includes a control circuit (controller) including a microcomputer equipped with a CPU_PD1, an I/O (interface) PD2, or the like. Signals from the CPU of the printer 500, each of switches of an operation panel PR1, or the like, and each of sensors, are input to the CPU_PD1 via a communication interface PD3, and then, the CPU_PD1 executes predetermined control on the basis of the input signal.

Further, the CPU_PD1 controls the driving of the solenoid and the motor via a driver and a motor driver, and obtains sensor information in the apparatus from the interface. Furthermore, the CPU_PD1 uses a motor driver to control the driving of the motor via the I/O interface PD2 in accordance with detection results of the sheet S as a control target, the sheet conveyance passage sensor S1 and the sheet conveyance passage sensor S2, etc., so as to obtain sensor information from sensors. Note that the control is executed based on the program from program codes stored in a ROM, loaded by the CPU_PD1 to be developed into a RAM, and defined by the program code while using the RAM as a work area and a data buffer.

The control of the stacker 100 in FIG. 20 is executed on the basis of an instruction or information from the CPU of the printer 500. The user's operation instruction is performed from the operation panel PR1 of the printer 500, and the printer 500 and the operation panel PR1 are mutually coupled via the communication interface PR2. This configuration allows an operation signal from the operation panel PR1 to be transmitted from the printer 500 to the stacker 100, as well as allowing the processing state and function of the stacker 100 to be notified to the user via the operation panel PR1.

With this configuration of the control system of the printer system 600, the CPU_PD1 determines the rotation direction and the rotation start timing of the ejection roller 111 or the like on the basis of the sheet S conveyance information transmitted from the printer 500 side, and then performs driving control and shift control.

Furthermore, the CPU_PD1 executes control of operating the main jogger and press a sheet bundle SB at a timing of completion of conveying the final sheet S of one session. Furthermore, after completion of alignment processing, the CPU_PD1 moves the main jogger backward to return to the start position and executes auxiliary operation of releasing the sheet bundle SB.

The CPU_PD1 includes a ROM and a RAM (data storage) functioning as data storage. The ROM stores data used for appropriately changing and controlling operation timings of the switcher 330 and operation timings of the fan motor 310 in accordance with the size and type of the sheet S.

The invention made by the present inventors has been specifically described as above on the basis of preferred embodiments. The present invention is not limited to the description in the above embodiments, and various modifications may be made without departing from the scope and spirit of the present invention.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A sheet stacker, comprising:

a sheet ejector to eject a sheet;

a sheet stack portion to stack the sheet ejected by the sheet ejector; and a plurality of air blowers to blow air from a plurality of blow ports toward the sheet ejected from the sheet ejector, each of the plurality of air blowers including:

an air generator to generate the air;

an air guide to guide the air to each of the plurality of blow ports;

a first blow portion to blow the air toward the sheet;

a second blow portion to blow the air in a direction different from a direction in which the first blow portion blows the air; and a switcher to perform switching so that the air guide guides the air to one of the first blow portion and the second blow portion, wherein the switcher is an air flow regulating member having a plurality of protrusions and configured such that an opposing interval of the protrusions decreases from upstream in an air flow direction toward downstream in the air flow direction.

2. An image forming apparatus comprising the sheet stacker according to claim 1.

3. An image system comprising:

an image forming apparatus; and the sheet stacker according to claim 1 to operate in conjunction with the image forming apparatus.

4. A sheet stacker, comprising:

a sheet ejector to eject a sheet;

a sheet stack portion to stack the sheet ejected by the sheet ejector; and a plurality of air blowers to blow air from a plurality of blow ports toward the sheet ejected from the sheet ejector, each of the plurality of air blowers including:

an air generator to generate the air;

an air guide to guide the air to each of the plurality of blow ports;

a first blow portion to blow the air toward the sheet;

a second blow portion to blow the air in a direction different from a direction in which the first blow portion blows the air; and a switcher to perform switching so that the air guide guides the air to one of the first blow portion and the second blow portion, wherein the second blow portion is disposed in middle of a conveyance path toward sheet ejection in the sheet ejector and blows the air toward the sheet under conveyance before being ejected in the sheet ejector.

5. An image forming apparatus comprising the sheet stacker according to claim 4.

6. An image system comprising:

an image forming apparatus; and the sheet stacker according to claim 4 to operate in conjunction with the image forming apparatus.

* * * * *